US011609511B2

(12) United States Patent
Urayama et al.

(10) Patent No.: US 11,609,511 B2
(45) Date of Patent: Mar. 21, 2023

(54) DEVELOPING DEVICE AND IMAGE FORMING APPARATUS HAVING A REVERSE HELICAL BLADE ON A DOWNSTREAM END OF A DEVELOPER TRANSPORT PATH

(71) Applicant: FUJIFILM Business Innovation Corp., Tokyo (JP)

(72) Inventors: Kenta Urayama, Kanagawa (JP); Yoshifumi Ozaki, Kanagawa (JP); Tomoyuki Yoshii, Kanagawa (JP); Norihiro Tamazawa, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/468,102

(22) Filed: Sep. 7, 2021

(65) Prior Publication Data

US 2022/0373933 A1 Nov. 24, 2022

(30) Foreign Application Priority Data

May 21, 2021 (JP) ..... JP2021-086039

(51) Int. Cl.
*G03G 15/08* (2006.01)

(52) U.S. Cl.
CPC ..... *G03G 15/0891* (2013.01); *G03G 15/0844* (2013.01); *G03G 15/0893* (2013.01); (Continued)

(58) Field of Classification Search
CPC ..... G03G 15/0891; G03G 15/0893; G03G 15/0844; G03G 2215/0827; G03G 2215/083; G03G 2215/0841
See application file for complete search history.

(56) References Cited

U.S. PATENT DOCUMENTS 5,510,881 A * 4/1996 Smith ..... G03G 15/0822 399/257
10,642,192 B2 5/2020 Ariizumi et al.
(Continued)

FOREIGN PATENT DOCUMENTS

JP 2018-194781 A 12/2018
JP 2019-40139 A 3/2019
JP 2019-101349 A 6/2019

*Primary Examiner* — Arlene Heredia
*Assistant Examiner* — Laura Roth
(74) *Attorney, Agent, or Firm* — Sughrue Mion, PLLC

(57) ABSTRACT

A developing device including a first transport path in which the developer to be supplied to the development-region passing body is transported at least in a first transport direction; a second transport path in which the developer to be sent to the first transport path is transported at least in a second transport direction; and a first connection portion through which a portion of the first transport path positioned short of a first-transport-direction-downstream end of the first transport path and a portion of the second transport path positioned short of a second transport-direction-upstream end of the second transport path are connected to one another. A first transport member in the first transport path has a helical reverse-transport blade that reverse-transports the developer in a reverse direction reverse to the first transport provided adjacent to the first connection portion.

19 Claims, 10 Drawing Sheets

(52) U.S. Cl.
CPC ..... *G03G 2215/083* (2013.01); *G03G 2215/0841* (2013.01)

(56) References Cited

U.S. PATENT DOCUMENTS

2011/0286769 A1* 11/2011 Mihara ..... G03G 15/0879
399/256
2018/0335722 A1* 11/2018 Ariizumi ..... G03G 15/0893

* cited by examiner

DEVELOPING DEVICE AND IMAGE FORMING APPARATUS HAVING A REVERSE HELICAL BLADE ON A DOWNSTREAM END OF A DEVELOPER TRANSPORT PATH

CROSS-REFERENCE TO RELATED APPLICATIONS

This application is based on and claims priority under 35 USC 119 from Japanese Patent Application No. 2021-086039 filed May 21, 2021.

BACKGROUND

(i) Technical Field

The present disclosure relates to a developing device and an image forming apparatus.

(ii) Related Art

Japanese Unexamined Patent Application Publication No. 2019-40139 (refer to, for example, paragraph 0020 and FIG. 2) discloses a developing device having a stirring chamber including a transport screw, a developing chamber including a transport screw and a developing sleeve, and two communication ports through which the stirring chamber and the developing chamber are connected to one another and a two-component developer is thus delivered from one chamber to the other chamber. One of the two communication ports is a downstream communication port positioned downstream in the direction where the two-component developer is transported by the transport screw in the developing chamber. In addition, the transport screw in the developing chamber has a rotating shaft on which a normally wound helical blade that transports the two-component developer in the above-described direction is provided. The normally wound blade extends to the above-described downstream communication port.

SUMMARY

Aspects of non-limiting embodiments of the present disclosure relate to a developing device and an image forming apparatus provided with the developing device. The developing device has a first transport member having a rotating shaft on which a helical forward-transport blade is provided. The helical forward-transport blade forward-transports a developer in a first transport direction in a first transport path through which a developer to be supplied to a development-region passing body is transported. The developing device is capable of suppressing the density of a visible image that is developed in a partial region of a development region corresponding to a downstream portion of the first transport path in the first transport direction from becoming lower than the density of a visible image developed in the other region of the development region, compared with the case where the forward-transport blade is provided so as to reach at least an end, downstream in the first transport direction, of a first connection portion through which a portion of the first transport path positioned short of the downstream end of the first transport path in the first transport direction is connected to a second transport path.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a developing device including: a development-region passing body that passes a development region while holding a developer; a first transport path in which the developer to be supplied to the development-region passing body is transported at least in a first transport direction; a second transport path in which the developer to be sent to the first transport path is transported at least in a second transport direction; a first connection portion through which a portion of the first transport path positioned short of a first-transport-direction-downstream end of the first transport path and a portion of the second transport path positioned short of a second transport-direction-upstream end of the second transport path are connected to one another; and a first transport member having a rotating shaft on which a helical first forward-transport blade is provided, the helical first forward-transport blade rotating to forward-transport the developer in the first transport direction in the first transport path, wherein: the first transport member has a helical reverse-transport blade that reverse-transports the developer in a reverse direction reverse to the first transport direction; the reverse-transport blade is provided on at least a portion of part of the rotating shaft adjacent to the first connection portion; and a reverse-direction-downstream end of the reverse-transport blade reaches at least a first-transport-direction-upstream end of the first connection portion.

BRIEF DESCRIPTION OF THE DRAWINGS

Exemplary embodiments of the present disclosure will be described in detail based on the following figures, wherein.

DETAILED DESCRIPTION

Hereinafter, exemplary embodiments according to the present disclosure will be described with reference to the drawings.

First Exemplary Embodiment

Figure 1:
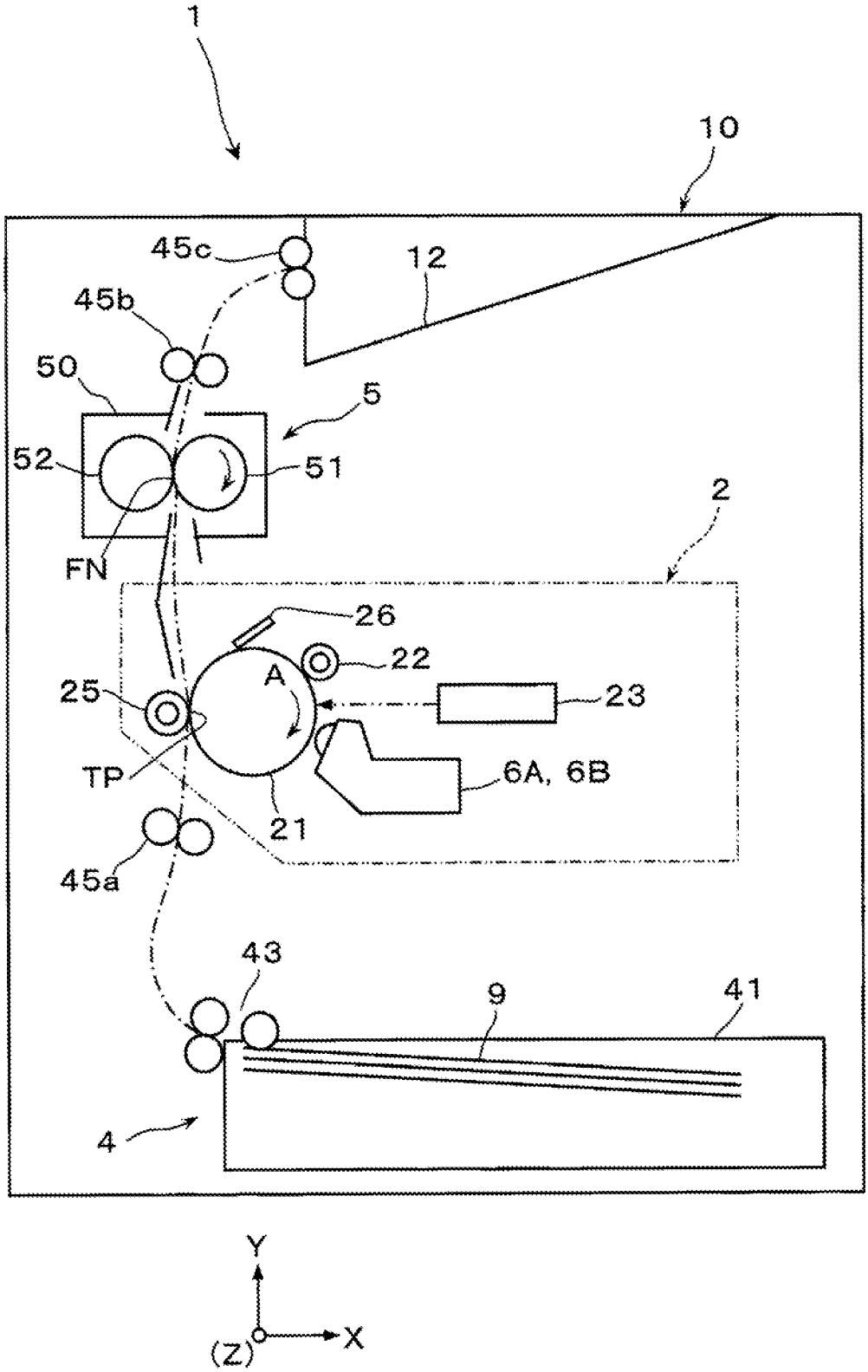
FIG. 1 schematically illustrates an image forming apparatus according to a first exemplary embodiment.

FIG. 1 illustrates an image forming apparatus 1 provided with a developing device 6A according to a first exemplary embodiment of the present disclosure.

The arrows denoted by references X, Y, and Z in a corresponding figure such as FIG. 1 indicate, respectively, a right-and-left direction (the horizontal direction), an up-and-down direction (the vertical direction), and a back-and-forth direction (the horizontal direction). In each figure, a circle at the point where the arrows of the directions X and Y intersect one another indicates that the direction of arrow Z is directed vertically downward with respect to the figure (the plane of paper).

Image Forming Apparatus

The image forming apparatus 1 according to the first exemplary embodiment is an apparatus that forms an image on a recording sheet 9 being an example of a recording medium by using an electrophotographic system. The image forming apparatus 1 is, for example, a printer that forms an image corresponding to the image information input from an external connection device such as an information terminal device.

As FIG. 1 illustrates, the image forming apparatus 1 has a housing 10 having a required appearance. In the inner space of the housing 10, the image forming apparatus 1 includes: an image forming device 2 that forms a toner image made of, as a developer, toner based on image information and transfers the toner image onto the recording sheet 9 being an example of the recording medium; a sheet feeding device 4 that accommodates and feeds the recording sheets 9 to be fed to a position in the image forming device 2 at which the transfer is performed; a fixing device 5 that fixes the toner image transferred at the image forming device 2, to the recording sheet 9; a controlling unit (not illustrated); and other constituents.

The dot-and-dash line in FIG. 1 indicates one of the transport paths when the recording sheet 9 is transported in the housing 10.

The image forming device 2 includes a photoconductor drum 21 that is an example of a latent image holding body on which a latent image is formed and held. The image forming device 2 includes, around the photoconductor drum 21, devices such as a charging device 22, an exposure device 23, the developing device 6A, a transfer device 25, and a cleaning device 26.

In such devices, the photoconductor drum 21 is a photoconductor in a drum form that rotates, in the direction denoted by arrow A, about a rotational axis (not illustrated) extending in the depth direction Z. The charging device 22 is a device that charges the outer circumferential surface (surface on which an image is formed) of the photoconductor drum 21 to a required surface potential. The charging device 22 has, for example, a charging member such as a roller that is in contact with an image forming region of the outer circumferential surface of the photoconductor drum 21 and to which a charging current is supplied. The exposure device 23 is a device that forms an electrostatic latent image by exposing the charged outer circumferential surface of the photoconductor drum 21 to light based on image information.

The developing device 6A is a device that develops the electrostatic latent image formed on the outer circumferential surface of the photoconductor drum 21 by using a developer (toner) corresponding to a predetermined color (for example, black) and that forms a toner image being an example of a visible image. The details of the developing device 6A will be described later.

The transfer device 25 is a device that electrostatically transfers the toner image formed on the outer circumferential surface of the photoconductor drum 21 onto the recording sheet 9. The transfer device 25 is constituted by a transfer member such as a roller that is in contact with the outer circumferential surface of the photoconductor drum 21 and to which transfer current is supplied. The cleaning device 26 is a device that cleans the outer circumferential surface of the photoconductor drum 21 by removing, in a scraping manner, unwanted substances such as unwanted toner and paper dust that adhere to the outer circumferential surface of the photoconductor drum 21.

In the image forming device 2, the position at which a portion of the photoconductor drum 21 and a portion of the transfer device 25 face one another is a transfer position TP at which the transfer of the toner image is performed.

The sheet feeding device 4 is disposed below the image forming device 2. In the sheet feeding device 4, devices such as a sheet tray 41 that accommodates the recording sheets 9 and a feeder 43 that sends out the recording sheets 9 one by one are disposed.

The recording sheet 9 may be any medium such as plain paper, coated paper, or thick paper that is able to be transported in the housing 10 and to which a toner image is able to be transferred and fixed, and, for example, the material and form of the recording sheet 9 are not particularly limited. A recording medium represented by the recording sheet 9 may be any paper that is able to be transported in the housing 10 and to which a toner image is able to be transferred and fixed.

The fixing device 5 is disposed above the transfer position TP of the image forming device 2. The fixing device 5 has a housing 50 having an inlet and an outlet for the recording sheets 9. In the inner space of the housing 50, devices such as a heating rotatable body 51 and a pressurizing rotatable body 52 are disposed.

In the fixing device 5, the heating rotatable body 51 and the pressurizing rotatable body 52 are arranged so as to be in contact with one another in a substantially horizontal state. In the fixing device 5, a portion of the heating rotatable body 51 and a portion of the pressurizing rotatable body 52 that are in contact with one another constitute a fixing part (nip part) FN. The nip part FN performs, for example, heating and pressurizing to fix an unfixed toner image to the recording sheet 9.

In the transport path of the recording sheet 9 in the housing 10, there are disposed, for example, plural transport rollers 45*a*, 45*b*, and 45*c* that transport the recording sheet 9 while nipping the recording sheet 9 and plural guide members (not illustrated) that ensure a space for transporting the recording sheet 9 and guide the recording sheet 9 while transporting the recording sheet 9.

When the controlling unit (not illustrated) receives a command for an image forming operation, in the image forming apparatus 1, a charging operation, an exposure operation, a developing operation, and a transfer operation are performed at the image forming device 2, while an operation of feeding the recording sheet 9 to the transfer position TP is performed at the sheet feeding device 4.

Thus, after being formed on the photoconductor drum 21, a toner image is transferred onto the recording sheet 9 that has been fed from the sheet feeding device 4 and has reached the transfer position TP.

Subsequently, in the image forming apparatus 1, the recording sheet 9 onto which the toner image has been transferred is introduced into the nip part FN, and the fixing operation is performed at the fixing device 5.

Thus, the unfixed toner image is fixed to the recording sheet 9.

The recording sheet 9 after being subjected to such fixation is transported by, for example, the transport rollers

45*b* and 45*c* and is then discharged to an output sheet tray 12 provided in an upper surface portion of the housing 10.

Accordingly, the image forming operation through which an image made of toner is formed on one side of the recording sheet 9 is completed.

Developing Device

Next, the developing device 6A according to the first exemplary embodiment will be described in detail.

Figure 2:
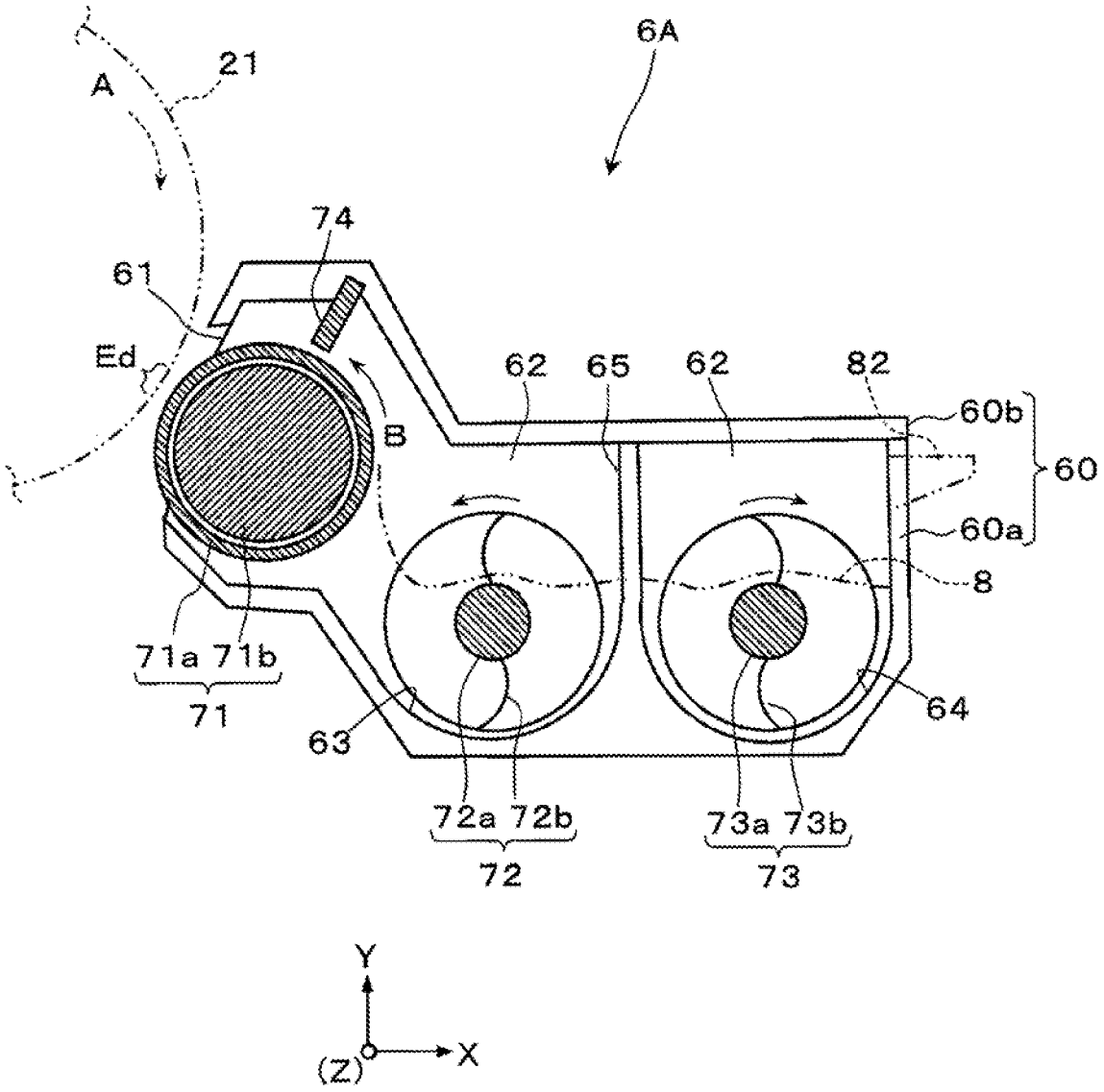
FIG. 2 schematically illustrates a developing device according to the first exemplary embodiment.

As FIG. 2 illustrates, the developing device 6A has a housing 60 constituted by a lower portion 60*a* having a container shape having an opening on the upper side and an upper portion 60*b* having a lid shape for closing the upper side of the lower portion 60*a*. The housing 60 has an opening 61 for development and an accommodation portion 62 accommodating a developer 8. As the developer 8, for example, a two-component developer containing nonmagnetic toner and a magnetic career is used.

The opening 61 is a rectangular opening elongated in the depth direction Z and facing a development region Ed. The development region Ed is a region on the photoconductor drum 21 that extends along the rotational axis of the photoconductor drum 21 and in which a latent image is developed. The opening 61 is connected to the accommodation portion 62 on the side of the inner space of the housing 60 relative to the opening 61. Regarding the housing 60, in the lower portion 60*a* on the side of the inner space of the housing 60 relative to the opening 61, a developing roller 71 that is an example of a development-region passing body that passes the development region Ed while holding the developer 8 is rotatably disposed.

The developing roller 71 is constituted by a tubular developing sleeve 71*a* that rotates while holding the developer 8 and a magnetic roller 71*b* disposed, in a fixed manner, in the inner space of the developing sleeve 71*a*.

Figure 3:
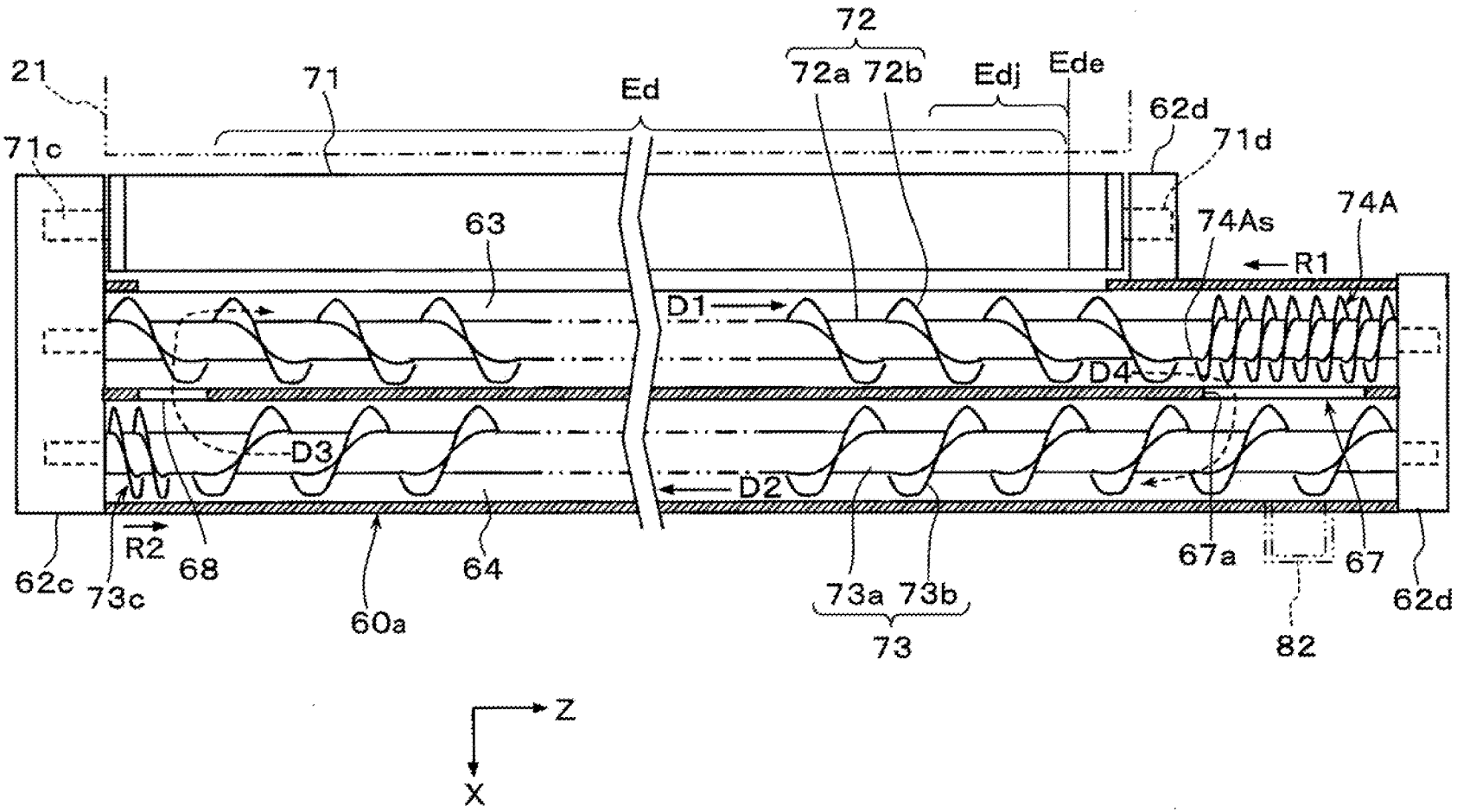
FIG. 3 schematically illustrates the developing device of FIG. 2 from which an upper portion of a housing is removed.

The developing sleeve 71*a* is made of a nonmagnetic material. Regarding the developing sleeve 71*a*, as FIG. 3 illustrates, shaft portions 71*c* and 71*d* at both ends of the developing sleeve 71*a* are rotatably attached to respective right and left wall portions 62*c* and 62*d* of the accommodation portion 62, and rotational power of a rotational drive device (not illustrated) is transmitted to the developing sleeve 71*a* to drive and rotate the developing sleeve 71*a* in the direction denoted by arrow B. Moreover, regarding the developing sleeve 71*a*, a developing bias is supplied to a region between the developing sleeve 71*a* and the photoconductor drum 21 from a power supplying device (not illustrated). Regarding the magnetic roller 71*b*, there are disposed plural magnetic poles that generate a magnetic force enabling functions such as attracting (picking up) the developer 8 to a surface of the developing sleeve 71*a*, transporting the developer 8 while holding the developer 8, and separating the developer 8 from the surface of the developing sleeve 71*a*.

As figures such as FIGS. 2 and 3 illustrate, the accommodation portion 62 has a first transport path 63 in which the developer 8 to be supplied to the developing roller 71 is transported and a second transport path 64 in which the developer 8 to be sent to the first transport path 63 is transported.

Each of the first transport path 63 and the second transport path 64 is a groove-shaped portion extending substantially parallel to the developing roller 71. While being separated from one another by a separation wall 65 provided between the transport paths, the first transport path 63 and the second transport path 64 are connected to one another through connection portions 67 and 68. Each of the connection portions 67 and 68 passing through the separation wall 65 is formed at a position that is short of a corresponding one of both ends of each of the first transport path 63 and the second transport path 64. Thus, the developer 8 transported in each of both the first transport path 63 and the second transport path 64 is able to move and be delivered from one transport path to an opposite transport path through the connection portions 67 and 68, and the first transport path 63 and the second transport path 64 are thereby configured as a circulation transport path in which the developer 8 is transported in a circulating manner.

The connection portion 67 is a first connection portion through which a portion of the first transport path 63 positioned short of the downstream end of the first transport path 63 in a first transport direction D1 where the developer 8 in the first transport path 63 is transported and a portion of the second transport path 64 positioned short of the upstream end of the second transport path 64 in a second transport direction D2 where the developer 8 in the second transport path 64 is transported are connected to one another. The connection portion 68 is a second connection portion through which a portion of the first transport path 63 positioned short of the upstream end of the first transport path 63 in the first transport direction D1 and a portion of the second transport path 64 positioned short of the downstream end of the second transport path 64 in the second transport direction D2 are connected to one another.

The first transport path 63 includes a first screw auger 72 as an example of a first transport member that forward-transports the developer 8 in the first transport direction D1 while stirring the developer 8.

The first screw auger 72 has a round-rod-shaped rotating shaft 72*a* disposed so as to rotate in the first transport path 63 and a forward-transport blade 72*b* that forward-transports the developer 8 in the first transport direction D1 and is wound in a spiral around the rotating shaft 72*a*. The helical forward-transport blade 72*b* is provided so as to extend in a spiral having a predetermined height, tilt angle, and pitch Pa.

The first screw auger 72 also has a reverse-transport blade 74A that reverse-transports the developer 8 in a reverse direction R1 that is a direction reverse to the first transport direction D1. The reverse-transport blade 74A is wound in a spiral around the part of the rotating shaft 72*a* adjacent to the first connection portion 67. The helical reverse-transport blade 74A is wound around the rotating shaft 72*a* in a direction reverse to the direction where the forward-transport blade 72*b* is wound, and the reverse-transport blade 74A draws a spiral having a predetermined height, tilt angle, and pitch Pb. The helical reverse-transport blade 74A will further be described later.

The second transport path 64 includes a second screw auger 73 as an example of a second transport member that forward-transports the developer 8 in the second transport direction D2 while stirring the developer 8.

The second screw auger 73 has a round-rod-shaped rotating shaft 73*a* disposed so as to rotate in the second transport path 64 and a forward-transport blade 73*b* that forward-transports the developer 8 in the second transport direction D2 and is wound, around the rotating shaft 73*a*, in a spiral having a predetermined height, tilt angle, and pitch.

The second screw auger 73 also has a reverse-transport blade 73*c* that reverse-transports the developer 8 in a reverse direction R2 that is a direction reverse to the second transport direction D2. The reverse-transport blade 73*c* is wound, around a portion of the part of the rotating shaft 73*a* adjacent to the second connection portion 68, in a spiral having a predetermined height, tilt angle, and pitch and is wound in a direction reverse to the direction where the forward-transport blade 73*b* is wound. The reverse-transport blade 73*c* may prevent the developer 8 from staying in a downstream end portion of the second transport path 64 in the second transport direction D2.

The rotational power transmitted to the developing sleeve 71*a* of the developing roller 71 is distributed to the first screw auger 72 and the second screw auger 73 by using a gear train mechanism (not illustrated); thus, each of the first screw auger 72 and the second screw auger 73 rotates at a predetermined speed in a predetermined direction, that is, for example, a corresponding one of the directions denoted by the arrows in FIG. 2.

A trimmer plate 74 as an example of an adjustment member that adjusts the amount (layer thickness) of the developer 8 held by the developing roller 71 is disposed on a portion of the upper portion 60*b* of the housing 60 near the opening 61. The trimmer plate 74 is attached to the upper portion 60*b* of the housing 60 in the state where a lower end portion of the trimmer plate 74 faces a surface (of the developing sleeve 71*a*) of the developing roller 71, parallel to the direction of the rotational axis of the developing sleeve 71*a*, with a predetermined gap interposed therebetween.

The developing device 6A operates as follows.

Regarding the developing device 6A, at a time, for example, when the developing operation is performed, as FIG. 2 illustrates, the developing sleeve 71*a* of the developing roller 71 starts to rotate in the direction denoted by arrow B and the first screw auger 72 and the second screw auger 73 also start to rotate in the respective directions indicated by the arrows.

Thus, in the second transport path 64, as figures such as FIGS. 2 and 3 illustrate, the helical forward-transport blade 73*b* of the rotating second screw auger 73 forward-transports the developer 8 in the second transport direction D2 while stirring the developer 8. At this time, the toner of the developer 8 that is a two-component developer is frictionally charged by the career to have a predetermined polarity (for example, a negative polarity). As arrow D3 of a broken line illustrates in FIG. 3, the developer 8 that has been forward-transported to a downstream region, in the second transport direction D2, of the second transport path 64 is sent to the first transport path 63 side at the second connection portion 68 while also receiving a reverse transport force applied by the helical reverse-transport blade 73*c*.

In addition, in the first transport path 63, the helical forward-transport blade 72*b* of the rotating first screw auger 72 forward-transports the developer 8 in the first transport direction D1 while stirring the developer 8. At this time, a portion of the developer 8 (specifically the toner) that is forward-transported is attracted to and supplied to the outer circumferential surface of the developing sleeve 71*a* of the developing roller 71 by a magnetic force and an electrostatic force. As arrow D4 of a broken line illustrates in FIG. 3, the developer 8 that has been forward-transported to a downstream region, in the first transport direction D1, of the first transport path 63 is sent to the second transport path 64 side at the first connection portion 67 while also receiving a reverse transport force applied by the helical reverse-transport blade 74A.

Moreover, in the developing roller 71, after the developer 8 that is the two-component developer forms a napped magnetic brush held on the outer circumferential surface of the rotating developing sleeve 71*a*, the magnetic brush of the developer 8 is transported in the direction denoted by arrow B to pass the trimmer plate 74. At this time, the developer 8 held on the outer circumferential surface of the developing sleeve 71*a* is caused to pass the development region Ed of the photoconductor drum 21 after the amount of the developer 8 held on the outer circumferential surface of the developing sleeve 71*a* is adjusted by the trimmer plate 74 limiting the passage of an extra portion of the developer 8.

In the development region Ed, the toner of the developer 8 on the outer circumferential surface of the developing sleeve 71*a* of the developing roller 71 is caused to move back and forth by a developing electric field formed between the developing roller 71 and the photoconductor drum 21 by a developing bias being supplied, and a portion of the toner adheres to a region of a latent image on the photoconductor drum 21 by an electrostatic force and is provided for developing the latent image. After passing the development region Ed, a portion of the toner and the career of the developer 8 that has not been used for the development at this time is separated from the developing sleeve 71*a* inside the accommodation portion 62 and returned to the first transport path 63.

Regarding the developing device 6A, as FIG. 3 illustrates, in the development region Ed, the density of the toner image developed in a partial region Edj corresponding to a downstream portion of the first transport path 63 in the first transport direction D1 may be lower than the density of the toner image developed in a region other than the partial region Edj. In practice, the density of the above-described toner image is observed by referring to the density of a corresponding image portion fixed to the recording sheet 9. The partial region Edj constitutes, for example, about 1% to 50% of the entire development region Ed.

such an event that the density of the toner image developed in the partial region Edj is decreased is more likely to occur as the length of the development region Ed in the rotational axis direction increases (for example, having a length of more than or equal to 165 mm).

Detailed Configuration of Developing Device

Figure 4:
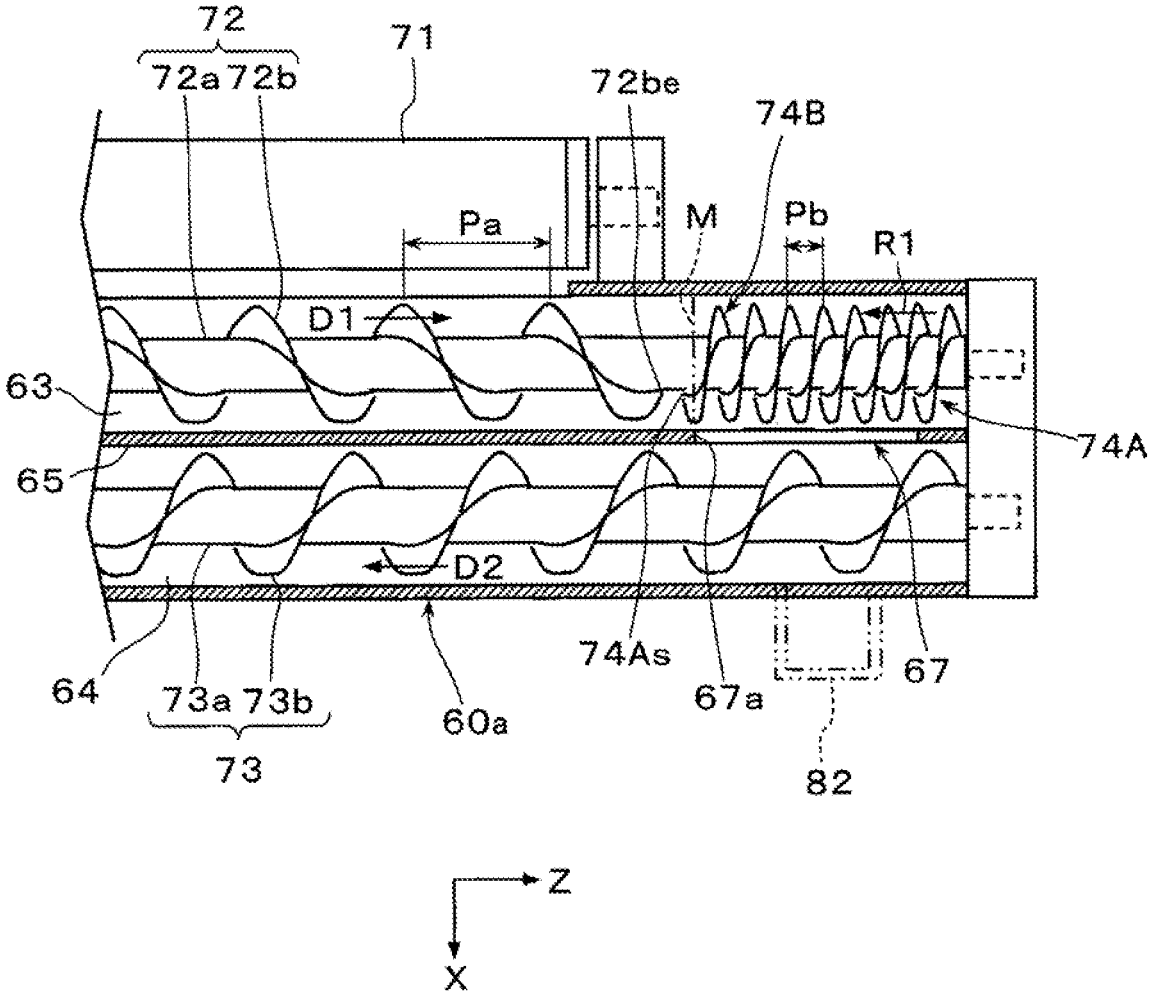
FIG. 4 is a schematic enlarged view of a portion of the developing device.

Thus, as figures such as FIGS. 3 and 4 illustrate, the developing device 6A includes the helical reverse-transport blade 74A provided on at least a portion of the part of the rotating shaft 72*a* of the first screw auger 72 adjacent to the first connection portion 67 so that an end 74As, downstream in the reverse direction R1, of the reverse-transport blade 74A reaches at least an end 67*a*, upstream in the first transport direction D1, of the first connection portion 67.

As FIG. 4 illustrates, the helical reverse-transport blade 74A according to the first exemplary embodiment is provided so that the end 74As, downstream in the reverse direction R1, of the reverse-transport blade 74A exceeds the position of the end 67*a*, upstream in the first transport direction D1, of the first connection portion 67, and the end 74As of the reverse-transport blade 74A is thus positioned in the first transport path 63, upstream in the first transport direction D1 relative to the end 67*a* of the first connection portion 67. In other words, the helical reverse-transport blade 74A here is provided astride a boundary M of the first transport path 63 with the first connection portion 67.

The helical reverse-transport blade 74A according to the first exemplary embodiment is provided on the entire part of the rotating shaft 72*a* adjacent to the first connection portion 67.

The pitch Pb of the helical reverse-transport blade 74A is set to a value smaller than the value of the pitch Pa of the forward-transport blade 72*b* (Pb<Pa), and the pitch Pb may be set to a value smaller than the value of half the pitch Pa of the forward-transport blade 72*b*, in view of, for example, holding back briefly a portion of the forward-transported developer 8 in the downstream region, in the first transport direction D1, of the first transport path 63. In addition, regarding the helical reverse-transport blade 74A, the tilt angle of the spiral relative to the axis of the rotating shaft 72*a* is set to a value larger than the value of the tilt angle of the forward-transport blade 72*b*, that is, for example, about 80 to 90 degrees close to the value of an angle orthogonal to the axis of the rotating shaft 72*a*.

Moreover, as FIG. 3 illustrates, the helical reverse-transport blade 74A is provided so that the end 74As, downstream in the revere direction R1, of the reverse-transport blade 74A is positioned downstream in the first transport direction D1 relative to an end Ede, downstream in the first-transport-direction, of a portion of the developing roller 71 facing the development region Ed, without exceeding the position of the end Ede, downstream in the first transport direction, of a portion of the developing roller 71. When the downstream end 74As of the helical reverse-transport blade 74A exceeds the position of the end Ede, downstream in the first transport direction D1, of the development region Ed and is thus positioned upstream in the first transport direction D1 relative to the end Ede of the development region Ed, the density of the developer 8 in a downstream portion of the first transport path 63 is likely to fluctuate by being moved by the helical reverse-transport blade 74A of the first screw auger 72, and the development corresponding to the downstream portion of the first transport path 63 may thereby be unstably performed to cause fluctuations in the density of the developed toner image.

As FIG. 4 illustrates, the helical reverse-transport blade 74A is provided so that the end 74As, downstream in the reverse transport direction R1, of the reverse-transport blade 74A is positioned, in the first transport path 63, further upstream in the first transport direction D1 than the end 67*a*, upstream in the first transport direction D1, of the first connection portion 67 by a distance equal to about a quarter the pitch. When the end 74As, downstream in the reverse direction R1, of the helical reverse-transport blade 74A is positioned, in the first transport path 63, further upstream in the first transport direction D1 than the end 67*a*, upstream in the first transport direction D1, of the first connection portion 67, the distance between the end 74As of the helical reverse-transport blade 74A and the end 67*a* of the first connection portion 67 may be less than or equal to one pitch. If such a distance between the ends 74As and 67*a* exceeds one pitch, the amount of the developer 8 that moves to the second transport path 64 is decreased, the amount of the developer 8 in the first transport path 63 is increased, and the driving load applied when the first screw auger 72 is rotated is thereby likely to increase.

At this time, as FIG. 4 illustrates, an end 72*be*, downstream in the first transport direction D1, of the helical forward-transport blade 72*b* of the first screw auger 72 is provided with a gap interposed, in the axial direction of the rotating shaft 72*a*, between the end 72*be* of the forward-transport blade 72*b* and the end 74As, downstream in the reverse direction R1, of the helical reverse-transport blade 74A. Due to such a gap being provided, the moving speed of the forward-transported developer 8 is lowered just before the developer 8 reaches the end 74As, downstream in the reverse direction R1, of the helical reverse-transport blade 74A. Thus, the developer 8 may be suppressed from moving forcefully when reaching the end 74As, downstream in the reverse direction R1, of the helical reverse-transport blade 74A and being subjected to the action of the reverse transport, and the developer 8 may thereby be likely to stay.

In the developing device 6A, when the screw auger 72 is rotated, the helical reverse-transport blade 74A of the screw auger 72 is rotated so as to temporarily block a path of the developer 8 that is forward-transported in the first transport path 63, at a portion of the first transport path 63 (the boundary M portion) near the end 67*a*, upstream in the first transport direction, of the first connection portion 67.

Thus, when the developer 8 in the first transport path 63 is forward-transported in the first transport direction D1 by the rotating first screw auger 72 and moves to the downstream region, in the first transport direction D1, of the first transport path 63, a portion of the forward-transported developer 8 comes into contact with and is held back by the helical reverse-transport blade 74A, thereby being suppressed from moving to the downstream region, in the first transport direction D1, of the first transport path 63 and suppressed from moving to the first connection portion 67.

Figure 5:
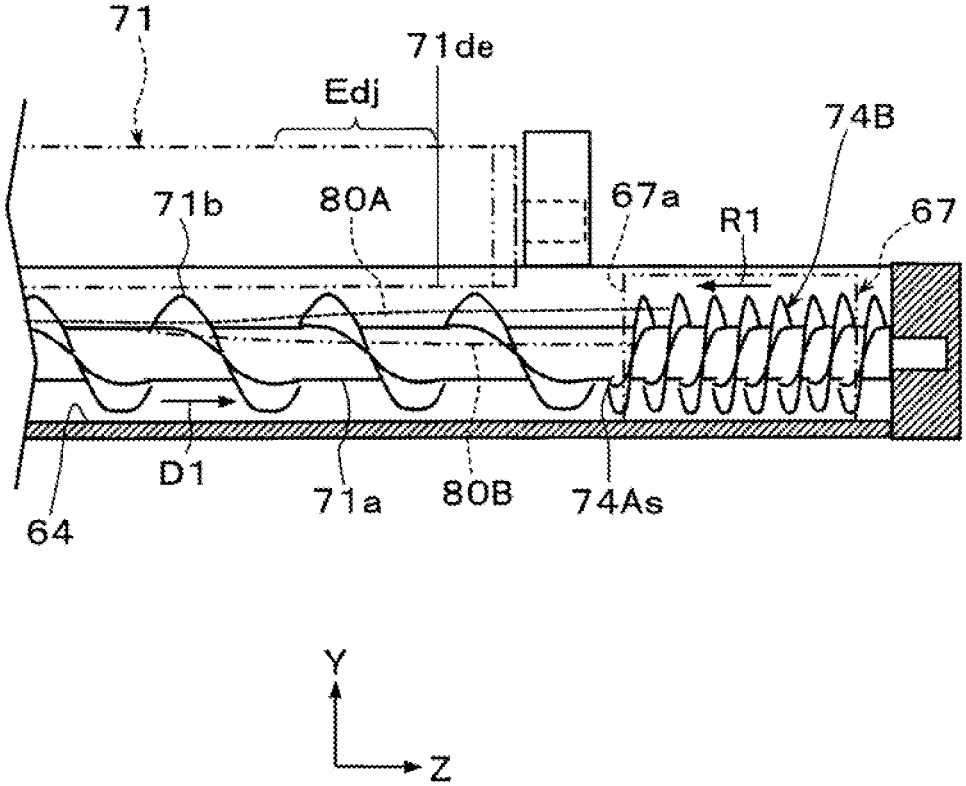
FIG. 5 schematically illustrates the portion of the developing device as viewed from a different position.

Consequently, in the downstream portion of the first transport path 63 in the first transport direction D1, as broken line 80A illustrates the level of the developer 8 in FIG. 5, the amount (bulkiness) of the developer 8 has become equal to or slightly more than the amount of the developer 8 in each of an upstream portion and a central portion of the first transport path 63. Moreover, due to such a state of the developer 8, the developing roller 71 may easily attract the sufficient amount of the developer 8 (specifically the toner) from the downstream portion of the first transport path 63, and there may thus be supplied the developer 8 of an amount substantially equal to the amount of the developer 8 in each of the upstream portion and the central portion of the first transport path 63.

In this respect, in the case of the first screw auger 72 having the helical forward-transport blade 72*b* reaching or exceeding the position in the first transport path 63 corresponding to the end 67*a*, downstream in the first transport direction D1, of the first connection portion 67, as dash-dot-dot line 80B illustrates the level of the developer 8 in FIG. 5, the amount of the developer 8 in a downstream portion of the first connection portion 67 in the first transport direction D1 may be smaller than the amount of the developer 8 in a portion of the first transport path 63 upstream in the first transport direction D1 relative to the downstream portion of the first connection portion 67.

Thus, in the developing device 6A, the development is also performed at a portion of the developing roller 71 corresponding to the partial region Edj of the development region Ed that corresponds to the portion, downstream in the first transport direction D1, of the first transport path 63, with substantially the same amount of the developer 8 as the amount of the developer 8 in a partial region other than the partial region Edj being supplied.

Thus, in the developing device 6A, the density of the toner image developed at the portion of the developing roller 71 corresponding to the above-described partial region Edj may be suppressed from becoming lower than the density of the toner image developed at a portion of the developing roller 71 corresponding to a region other than the partial region Edj, compared with the case where the helical forward-transport blade 72*b* is provided so as to reach at least the position of the end 67*a*, downstream in the first transport direction D1, of the first connection portion 67 of the first transport path 63.

In addition, in the image forming apparatus 1 provided with the developing device 6A, a relative decrease in the density of the image portion caused by a decrease in the density of the above-described toner image may be suppressed.

Note that, as the dash-dot-dot lines illustrate in figures such as FIGS. 2 and 5, the developing device 6A may have an injection port 82 through which the developer 8 (almost only the toner) is injected into the second transport path 64. The injection port 82 may be positioned on the upper side of the part of the second transport path 64 adjacent to the first connection portion 67.

In such a case, even if a portion of the developer 8 that has been injected into the second transport path 64 from the injection port 82 flows into the part of the first transport path 63 adjacent to the first connection portion 67, the developer 8 that has flowed into the part of the first transport path 63 may be sent by the reverse-transport blade 74A so as to be returned to the second transport path 64. Thus, the developer 8 that is injected into the second transport path 64 through the injection port 82 may flow into the second transport path 64 smoothly and is forward-transported by the second screw auger 73 in the second transport direction D2 while being stirred by the second screw auger 73.

Second Exemplary Embodiment

Figure 6:
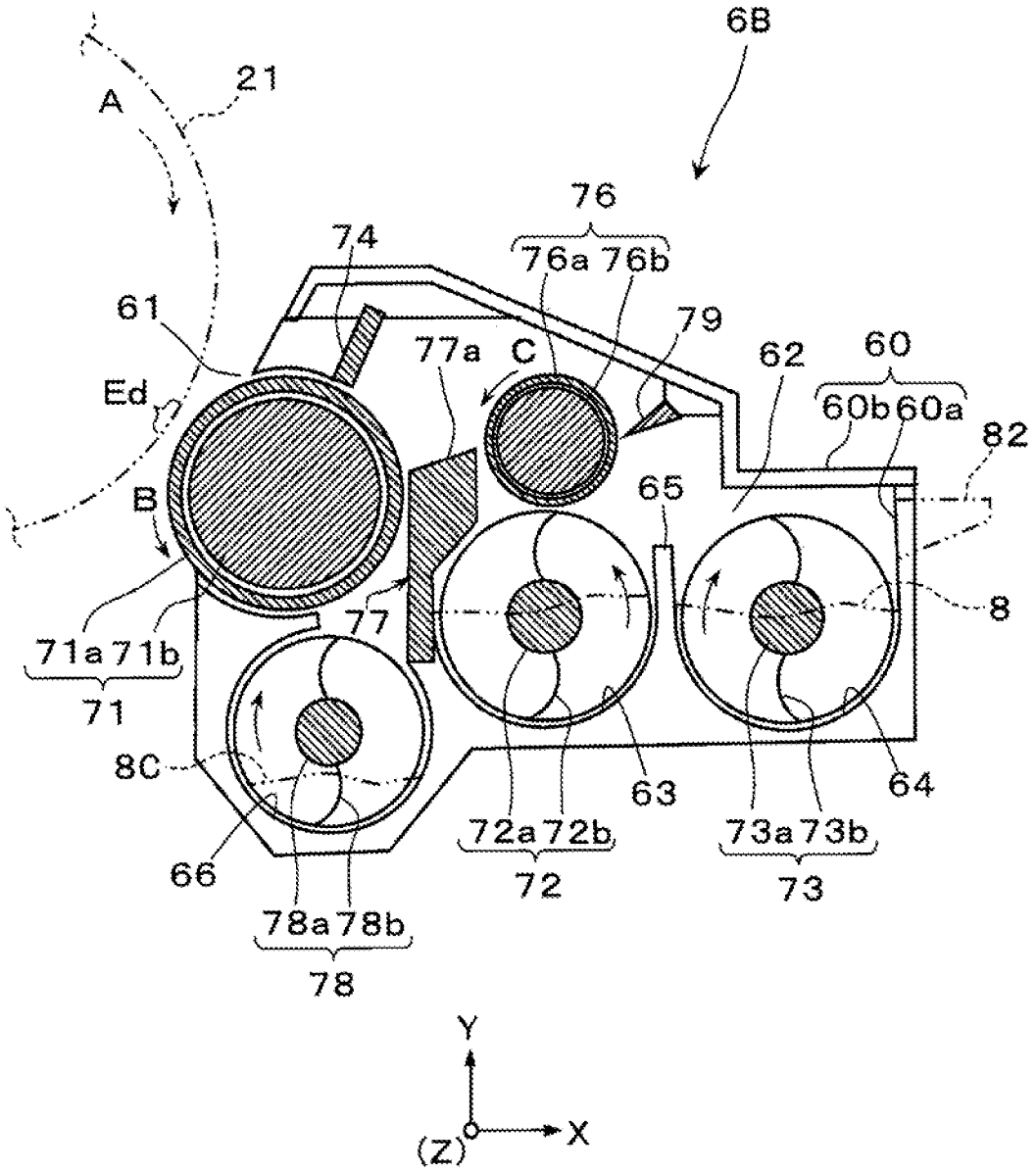
FIG. 6 schematically illustrates a developing device according to a second exemplary embodiment.

FIG. 6 illustrates a developing device 6B according to a second exemplary embodiment of the present disclosure.

The developing device 6B according to the second exemplary embodiment has the same configuration as the configuration of the developing device 6A according to the first exemplary embodiment except for a portion of the overall structure and a portion of the first screw auger 72 (for example, the helical reverse-transport blade). Thus, in the following description, the same constituent parts as those of the first exemplary embodiment are denoted by the same references as those denoted in the first exemplary embodiment, and the description of the constituent parts will be omitted unless necessary.

The developing device 6B is configured by adding a relay transport roller 76, a movement auxiliary member 77, a third screw auger 78, and a second trimmer plate 79 to the configuration of the developing device 6A according to the first exemplary embodiment.

The relay transport roller 76 is disposed above the first screw auger 72 and is an example of a developer transporting body that, after holding a portion of the developer 8 forward-transported by the first screw auger 72, relays and transports the portion of the developer 8 toward the developing roller 71.

The relay transport roller 76 is similar to the developing roller 71 and constituted by a tubular transport sleeve 76*a* that rotates while holding the developer 8 and a magnetic roller 76*b* disposed, in a fixed manner, in the inner space of the transport sleeve 76*a*. The transport sleeve 76*a* is made of a nonmagnetic material. The rotational power transmitted to the developing roller 71 or the first screw auger 72 is transmitted so as to be distributed to the transport sleeve 76*a*, thereby driving and rotating the transport sleeve 76*a* in the direction denoted by arrow C. Regarding the magnetic roller 76*b*, there are disposed plural magnetic poles that generate a magnetic force enabling functions such as attracting (picking up) the developer 8 to a surface of the transport sleeve 76*a*, transporting the developer 8 while holding the developer 8, and separating the developer 8 from the surface of the transport sleeve 76*a*.

The movement auxiliary member 77 is disposed between a portion of the developing roller 71 upstream in the rotation direction B relative to the trimmer plate 74 and the relay transport roller 76. The movement auxiliary member 77 is a nonmagnetic member having an inclined surface 77*a* that receives the developer 8 sent from the relay transport roller 76 and along which the developer 8 moves to the developing roller 71.

The third screw auger 78 is an example of a third transport member that transports at least a portion of a developer 8C that is separated from the developing roller 71 after passing the development region Ed, so as to return the portion of the developer 8C finally to the second transport path 64.

Figure 7:
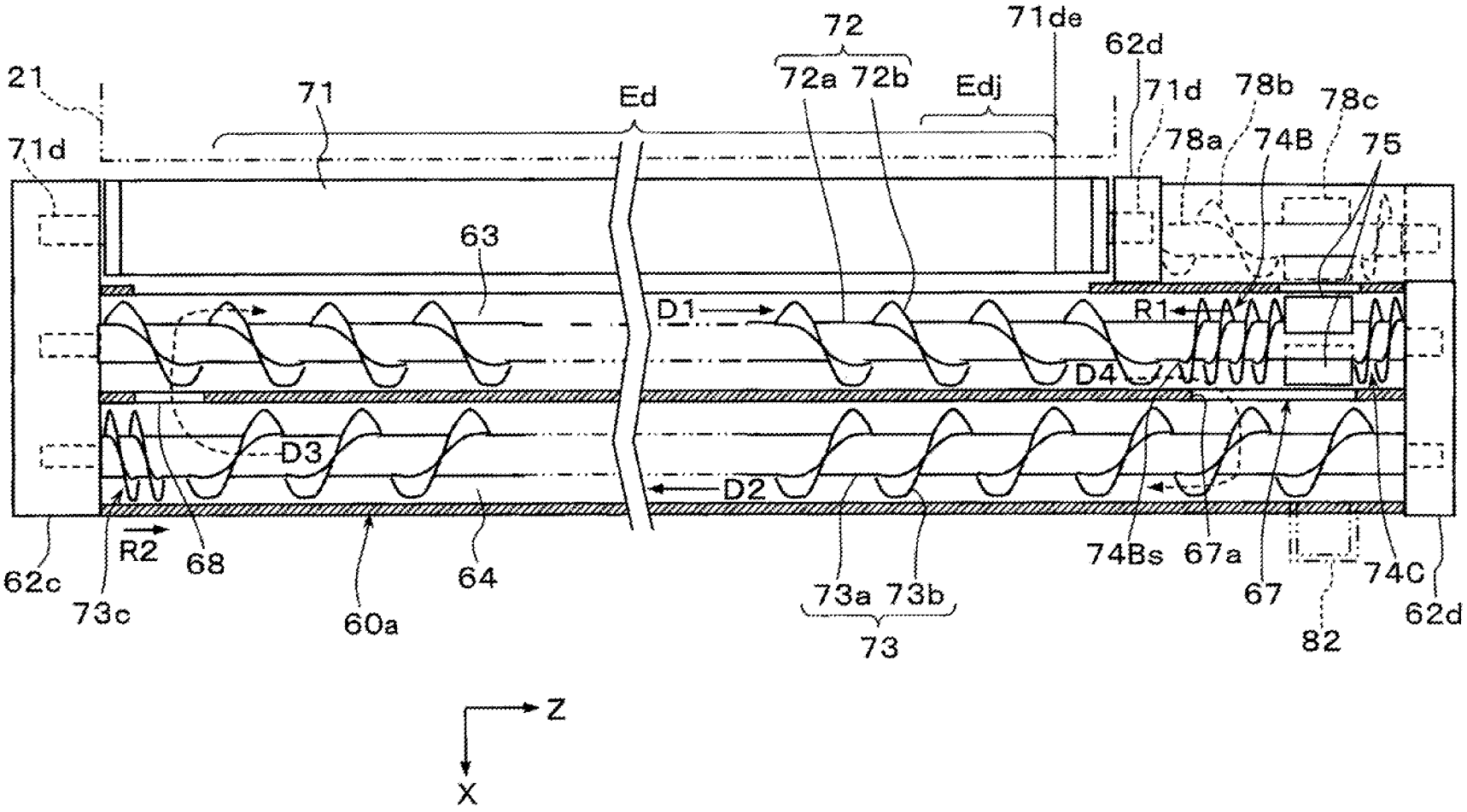
FIG. 7 schematically illustrates the developing device of FIG. 6 from which an upper portion of a housing is removed.

The third screw auger 78 is provided, in the lower portion 60*a* of the housing 60, below the developing roller 71 in a state of extending parallel to the rotational axis of the developing roller 71, and the third screw auger 78 is disposed in a third transport path 66 in which the developer 8C separated from the developing roller 71 is transported. As figures such as FIGS. 6 and 7 illustrate, the third transport path 66 is a groove-shaped portion formed by a portion of the lower portion 60*a* of the housing 60 that faces a portion of the developing roller 71 from which the developer 8 is separated having a continuous opening. In the third transport path 66, a third connection portion 69 is at a position that is short of a downstream end of the third transport path 66 in the third transport direction (in this example, the depth direction Z) in which the developer 8C is transported. The third transport path 66 communicates other transport paths through the third connection portion 69 and through the first connection portion 67 of the first transport path 63.

The third screw auger 78 has a round-rod-shaped rotating shaft 78*a* disposed so as to rotate in the third transport path 66 and a forward-transport blade 78*b* that forward-transports the developer 8C separated from the developing roller 71, in the third transport direction and is wound, around the rotating shaft 78*a*, in a spiral having a predetermined height, tilt angle, and pitch.

Moreover, the third screw auger 78 has plural plate-shaped transport blades 78*c* rising from the part of the rotating shaft 78*a* adjacent to the third connection portion 69. The transport blades 78*c* send the developer 8C to the first transport path 63 adjacent to the first connection portion 67. The third screw auger 78 also has a reverse-transport blade 78*d* that reverse-transports the developer 8C in a direction reverse to the third transport direction. The reverse-transport blade 78*d* is wound in a spiral around a portion of the rotating shaft 78*a* downstream in the third transport direction relative to the plate-shaped transport blades 78*c*.

The second trimmer plate 79 is an example of a second adjustment member that adjusts the amount (layer thickness) of the developer 8 held on the transport sleeve 76*a*. The second trimmer plate 79 is attached to the upper portion 60*b* of the housing 60 in the state where a lower end portion of the second trimmer plate 79 faces a surface (of the transport sleeve 76*a*) of the relay transport roller 76, parallel to the direction of the rotational axis of the transport sleeve 76*a*, with a predetermined gap interposed therebetween.

Next, regarding the first screw auger 72, in the developing device 6B, having a reverse-transport blade 74B that reverse-transports the developer 8 in the reverse direction R1 that is a direction reverse to the first transport direction D1, the reverse-transport blade 74B is wound in a spiral around, rather than the entire part, a portion of the part of the rotating shaft 72*a* adjacent to the first connection portion 67.

Figure 8:
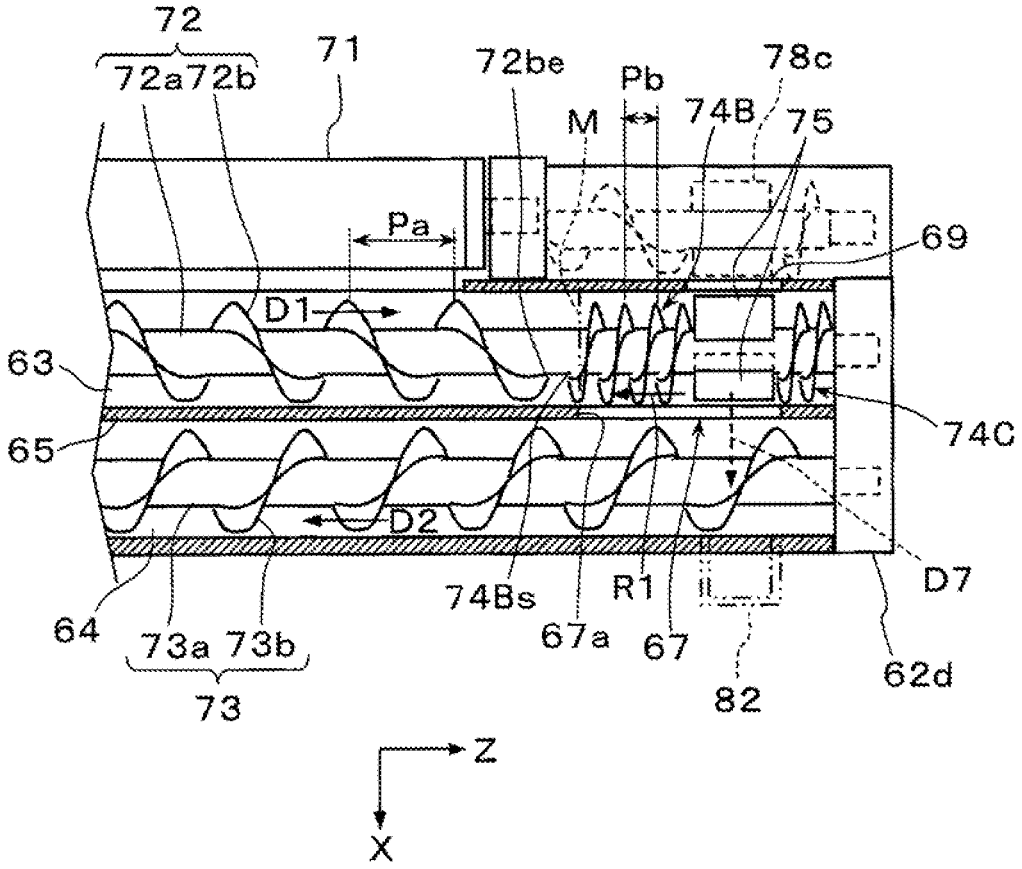
FIG. 8 is a schematic enlarged view of a portion of the developing device.

As figures such as FIGS. 7 and 8 illustrate, the helical reverse-transport blade 74B may be provided on the rotating shaft 72*a* so that the length of a portion of reverse-transport blade 74B protruding downstream in the first transport direction D1 from a position in the first transport path 63 (the boundary M portion) corresponding to the end 67*a*, upstream in the first transport direction D1, of the first connection portion 67 is more than or equal to three pitches. Specifically, such a length is equal to, for example, about three and a half pitches. In this respect, the first screw auger 72 of the second exemplary embodiment differs from the first screw auger 72 of the first exemplary embodiment. In addition, the helical reverse-transport blade 74B has the same configuration as the configuration of the helical reverse-transport blade 74A of the first exemplary embodiment except for a range in which the reverse-transport blade 74B is provided.

Figure 9:
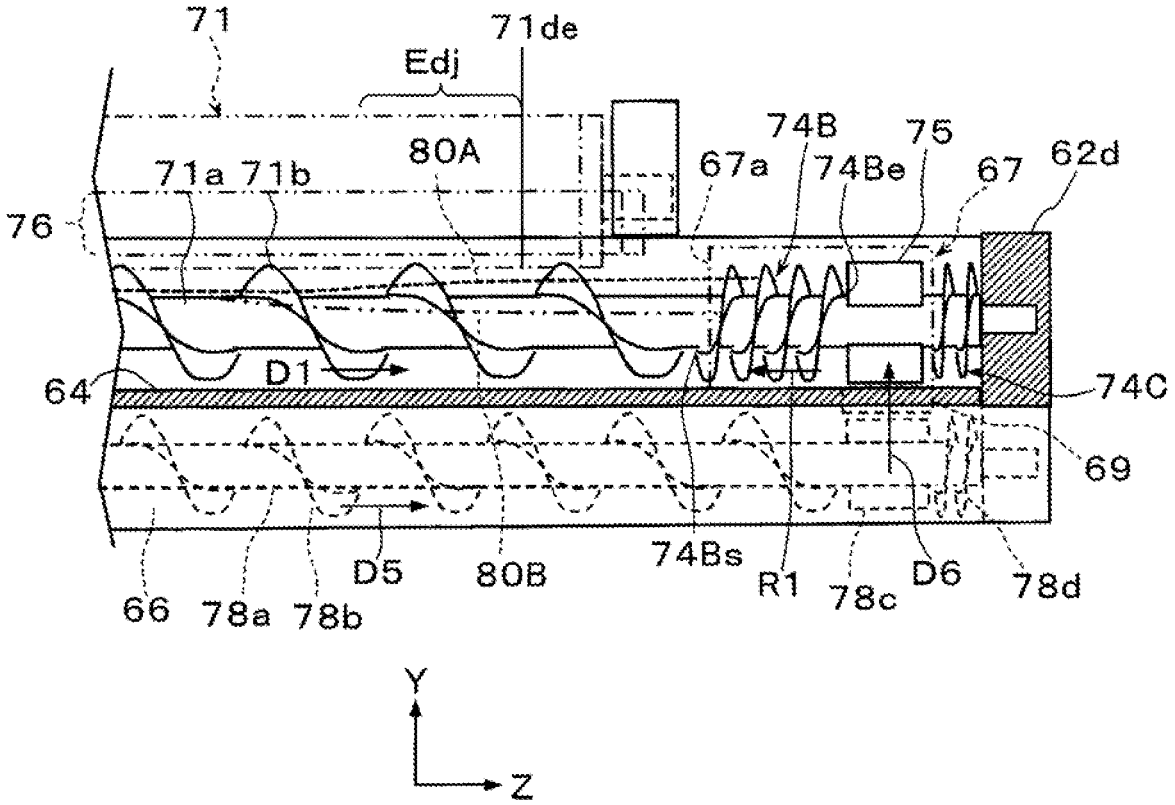
FIG. 9 schematically illustrates the portion of the developing device as viewed from a different position.

As a figure such as FIG. 9 illustrates, the first screw auger 72 in the developing device 6B has plate-shaped transport blades 75 that send, to the second transport path 64, the developer 8C sent from the third transport path 66. The plate-shaped transport blades 75 are provided on a portion of the rotating shaft 72*a* upstream in the reverse direction R1 relative to an end 74Be, upstream in the reverse direction R1, of the helical reverse-transport blade 74B. The first screw auger 72 of the second exemplary embodiment also differs from the first screw auger 72 of the first exemplary embodiment in that such plate-shaped transport blades 75 are provided.

The plate-shaped transport blades 75 are also referred to as paddles, and the plural transport blades 75 rise from the rotating shaft 72*a*. For each of the plate-shaped transport blades 75, for example, a plate member having a width substantially equal to the opening width of the third connection portion 69 in the third transport direction D5 is applicable.

Moreover, as a figure such as FIG. 8 illustrates, the first screw auger 72 has a helical reverse-transport blade 74C that reverse-transports the developer 8 in the reverse direction R1. The helical reverse-transport blade 74C is provided on a portion of the rotating shaft 72*a* positioned between the plate-shaped transport blades 75 and the end, downstream in the first transport direction D1, of the first transport path 63. The reverse-transport blade 74C may prevent the developer 8 and the developer 8C from staying in a downstream end portion of the first transport path 63 in the first transport direction D1.

The developing device 6B operates as follows.

Regarding the developing device 6B, at a time, for example, when the developing operation is performed, as FIG. 6 illustrates, the developing sleeve 71*a* of the developing roller 71 starts to rotate in the direction denoted by arrow B and the transport sleeve 76*a* of the relay transport roller 76, the first screw auger 72, the second screw auger 73, and the third screw auger 78 also start to rotate in the respective directions indicated by the arrows.

Thus, in the second transport path 64, as figures such as FIGS. 6 and 7 illustrate, the helical forward-transport blade 73*b* of the rotating second screw auger 73 forward-transports the developer 8 in the second transport direction D2 while stirring the developer 8. As arrow D3 of a broken line illustrates in FIG. 7, the developer 8 that has been forward-transported to a downstream region, in the second transport direction D2, of the second transport path 64 is sent to the first transport path 63 side at the second connection portion 68 while also receiving a reverse transport force applied by the helical reverse-transport blade 73*c*.

In addition, in the first transport path 63, the helical forward-transport blade 72*b* of the rotating first screw auger 72 forward-transports the developer 8 in the first transport direction D1 while stirring the developer 8.

At this time, above the first transport path 63, a portion of the developer 8 forward-transported by the first screw auger 72 is held on the outer circumferential surface of the transport sleeve 76*a* of the relay transport roller 76 by a magnetic force, and the portion of the developer 8 is then transported by the rotation of the transport sleeve 76*a* in the direction of arrow C.

When the developer 8 that is transported while being held on the transport sleeve 76*a* passes the second trimmer plate 79, the amount of the developer 8 held on the outer circumferential surface of the transport sleeve 76*a* is adjusted by the second trimmer plate 79 limiting the passage of an extra portion of the developer 8. Such an extra developer 8 drops into and is returned to the first transport path 63 and is forward-transported by the first screw auger 72 in the first transport direction. A portion of the returned developer 8 may be held on the relay transport roller 76 again.

The extra developer 8 held on the relay transport roller 76 is returned to the first transport path 63 by the second trimmer plate 79, and the amount of the developer 8 in a portion, downstream in the first transport direction D1, of the first transport path 63 may thereby be prevented from decreasing to maintain a certain amount of the developer 8 in the downstream portion, in the first transport direction D1, of the first transport path 63.

Subsequently, the developer 8 that is transported while being held on the transport sleeve 76*a* is separated from the surface of the transport sleeve 76*a* and delivered to the inclined surface 77*a* of the movement auxiliary member 77, at the position before the developer 8 passes the inclined surface 77*a* of the movement auxiliary member 77. The separated developer 8 slides along the nonmagnetic inclined surface 77*a*, moves to the developing roller 71, and is attracted to and thus supplied to the surface of the developing sleeve 71*a* of the developing roller 71 by, for example, a magnetic force.

On the other hand, as arrow D4 of a broken line illustrates in FIG. 7, the developer 8 that has been forward-transported to a downstream region, in the first transport direction D1, of the first transport path 63 is sent to the second transport path 64 side at the first connection portion 67 while also receiving a reverse transport force applied by the helical reverse-transport blade 74B.

Moreover, in the developing roller 71, after the developer 8 that is the two-component developer and is supplied by sliding along the inclined surface 77*a* of the movement auxiliary member 77, forms a napped magnetic brush held on the outer circumferential surface of the rotating developing sleeve 71*a*, the magnetic brush of the developer 8 is transported in the direction denoted by arrow B to pass the trimmer plate 74. At this time, the developer 8 held on the outer circumferential surface of the developing sleeve 71*a* passes the development region Ed of the photoconductor drum 21 after the amount of the developer 8 held on the outer circumferential surface of the developing sleeve 71*a* is adjusted by the trimmer plate 74 limiting the passage of an extra portion of the developer 8.

In the development region Ed, a portion of the toner of the developer 8 that is transported while being held on the outer circumferential surface of the developing sleeve 71*a* of the developing roller 71 adheres to a region of a latent image on the photoconductor drum 21 by an electrostatic force and is used for developing the latent image. After passing the development region Ed, a portion of the toner and the career of the developer 8C that is not used for the development at this time is sent, inside the accommodation portion 62, so as to be separated from the developing sleeve 71*a* and drop into the third transport path 66.

In the third transport path 66, as FIG. 9 illustrates, the forward-transport blade 78*b* of the rotating third screw auger 78 forward-transports the developer 8C that has been separated and dropped from the developing sleeve 71*a*, to the downstream side in the third transport direction D5.

The developer 8C that has been forward-transported to a downstream region of the third transport path 66 in the third transport direction D5 is sent to the first transport path 63 by the plate-shaped transport blades 78*c*, at the part of the third transport path 66 adjacent to the third connection portion 69. Subsequently, as arrow D6 illustrates in FIG. 9, the developer 8C that has been transported to the first transport path 63 is sent to the second transport path 64 by the plate-shaped transport blades 75 of the first screw auger 72. Lastly, the developer 8C that has been sent to the second transport path 64 is forward-transported in the second transport direction D2 by the second screw auger 73, while being mixed with the developer 8 that has already been in the second transport path 64.

In the developing device 6B, when the first screw auger 72 is rotated, the helical reverse-transport blade 74B of the first screw auger 72 functions as with the helical reverse-transport blade 74A of the first exemplary embodiment and is rotated so as to temporarily block the path of the developer 8 that is forward-transported in the first transport path 63, at a portion of the first transport path 63 (the boundary M portion) near the end 67*a*, upstream in the first transport direction, of the first connection portion 67.

Thus, when the developer 8 in the first transport path 63 is forward-transported in the first transport direction D1 by the rotating first screw auger 72 and moves to the downstream region, in the first transport direction D1, of the first transport path 63, a portion of the forward-transported developer 8 comes into contact with and is held back by the helical reverse-transport blade 74B, thereby being suppressed from moving to the downstream region, in the first transport direction D1, of the first transport path 63 and suppressed from moving to the first connection portion 67.

Consequently, in the downstream portion of the first transport path 63 in the first transport direction D1, as broken line 80A illustrates the level of the developer 8 in FIG. 9, the amount (bulkiness) of the developer 8 has become equal to or slightly more than the amount of the developer 8 in each of the upstream portion and the central portion of the first transport path 63. Moreover, due to such a state of the developer 8, the developing roller 71 may easily attract the sufficient amount of the developer 8 (specifically the toner) from the downstream portion of the first transport path 63, and there may thus be supplied the developer 8 of an amount substantially equal to the amount of the developer 8 in each of the upstream portion and the central portion of the first transport path 63.

In this respect, in the case where the helical forward-transport blade 72*b* of the first screw auger 72 reaches or exceeds the position in the first transport path 63 corresponding to the end 67*a*, downstream in the first transport direction D1, of the first connection portion 67, as dash-dot-dot line 80B illustrates the level of the developer 8 in FIG. 9, the amount of the developer 8 in a downstream portion of the first connection portion 67 in the first transport direction D1 may be smaller than the amount of the developer 8 in a portion of the first transport path 63 upstream in the first transport direction D1 relative to the downstream portion of the first connection portion 67.

Thus, in the developing device 6B, the development is also performed at a portion of the developing roller 71 corresponding to the partial region Edj of the development region Ed that corresponds to the portion, downstream in the first transport direction D1, of the first transport path 63, with substantially the same amount of the developer 8 as the amount of the developer 8 in a partial region other than the partial region Edj being supplied.

Thus, in the developing device 6B, the density of the toner image developed at the portion of the developing roller 71 corresponding to the above-described partial region Edj may also be suppressed from becoming lower than the density of the toner image developed at a portion of the developing roller 71 corresponding to a region other than the partial region Edj, compared with the case where the helical forward-transport blade 72*b* is provided so as to reach at least the position of the end 67*a*, downstream in the first transport direction D1, of the first connection portion 67 of the first transport path 63.

In addition, in the image forming apparatus 1 (FIG. 1) provided with the developing device 6B, a relative decrease in the density of the image portion caused by a decrease in the density of the above-described toner image may also be suppressed.

In addition, in the developing device 6B, the first screw auger 72 has the helical reverse-transport blade 74B provided upstream in the first transport direction D1 relative to the plate-shaped transport blades 75. Thus, for example, even if a portion of the developer 8C transported by the plate-shaped transport blades 75 moves into a region of the reverse-transport blade 74B, the portion of the developer 8C may be sent to the second transport path 64 by the reverse-transport blade 74B through the first connection portion 67.

Moreover, as figures such as FIGS. 7 and 8 illustrate, in the developing device 6B, the first connection portion 67 is formed continuously to a position facing the plate-shaped transport blades 75. Thus, compared with the case where the first connection portion 67 is not formed continuously to the position facing the plate-shaped transport blades 75, the developer 8C sent by the plate-shaped transport blades 75 may easily move into the second transport path 64 through the first connection portion 67. Even if a portion of the developer 8C moves into the region of the helical reverse-transport blade 74B, the portion of the developer 8C may be sent to the second transport path 64 by the reverse-transport blade 74B through the first connection portion 67.

Note that, as the dash-dot-dot lines illustrate in FIGS. 6 to 8, the developing device 6B may also have the injection port 82 through which the developer 8 (almost only the toner) is injected into the second transport path 64. The injection port 82 may be positioned on the upper side of the part of the second transport path 64 adjacent to the first connection portion 67.

In such a case, even if a portion of the developer 8 that has been injected into the second transport path 64 from the injection port 82 flows into the part of the first transport path 63 adjacent to the first connection portion 67, the developer 8 that has flowed into the part of the first transport path 63 may be sent by one of or both of the reverse-transport blade 74B and the plate-shaped transport blades 75 so as to be returned to the second transport path 64. Thus, the developer 8 that has been injected into the second transport path 64 from the injection port 82 may flow into the second transport path 64 smoothly and is forward-transported in the second transport direction D2 while being stirred by the second screw auger 73.

Modification

The present disclosure is not limited to the contents exemplified by the first and second exemplary embodiments and includes, for example, the following modification.

Figure 10:
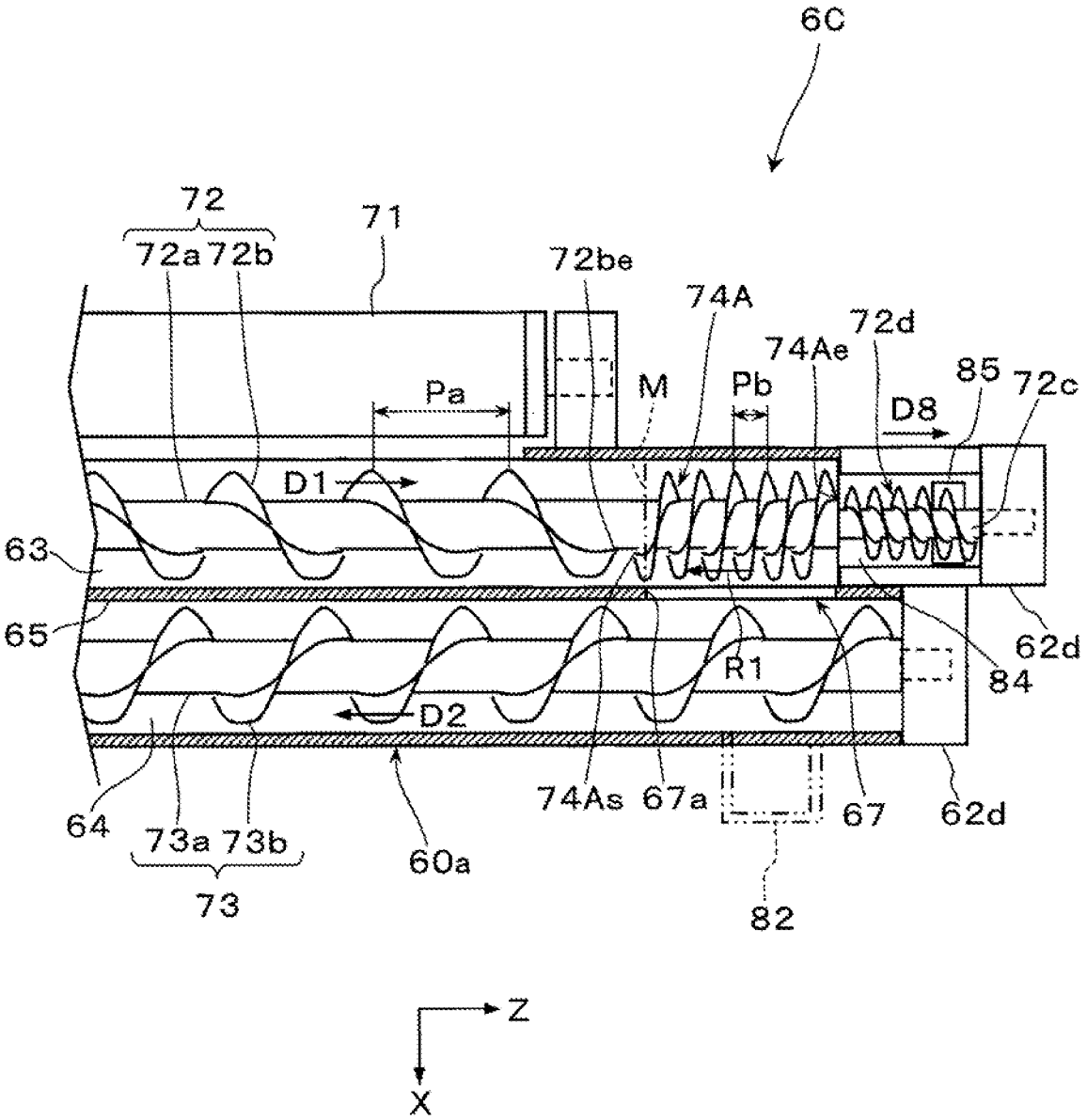
FIG. 10 schematically illustrates a developing device configured by modifying a portion of the developing device according to the first exemplary embodiment.

FIG. 10 illustrates a portion of a developing device 6C having the configuration of the developing device 6A according to the first exemplary embodiment, the portion being modified.

The developing device 6C has a groove-shaped extension transport path 84 that is a portion extending from the end, downstream in the first transport direction D1, of the first transport path 63 of the developing device 6A. The extension transport path 84 has a section smaller than the section of the first transport path 63 and has a bottom raised one step from the bottom of the first transport path 63. In addition, a discharge port 85 through which a portion of the developer 8 is discharged is provided, in the bottom of the extension transport path 84, beside an end of the extension transport path 84 on the side wall portion 62*d* side. The discharge port 85 is provided for collecting a portion of the developer 8 that has not been provided for the developing operation and whose performance required for the development has been reduced. The discharge port 85 is connected to a collection container (not illustrated) that accommodates the collected developer.

The developing device 6C further includes an extension rotating shaft 72*c* extending from an end, downstream in the first transport direction D1, of the rotating shaft 72*a* of the first screw auger 72. The extension rotating shaft 72*c* having a diameter smaller than the diameter of the rotating shaft 72*a* of the first screw auger 72 is rotatably attached to the side wall portion 62*d* of the accommodation portion 62.

Moreover, the developing device 6C includes a helical extension forward-transport blade 72*d* provided on the extension rotating shaft 72*c* positioned further upstream than an end 74Ae, upstream in the reverse direction R1, of the reverse-transport blade 74A of the first screw auger 72. The extension forward-transport blade 72*d* forward-transports the developer 8 in an extension transport direction D8. The extension forward-transport blade 72*d* has a height and a pitch smaller than the height and the pitch of the forward-transport blade 72*b* but has a tilt angle larger than the tilt angle of the forward-transport blade 72*b*.

In the developing device 6C, a portion of the developer 8 that is forward-transported downstream in the first transport direction D1 in the first transport path 63 by the first screw auger 72 is held back by the reverse-transport blade 74A, and the remaining developer 8 moves into a region of the extension forward-transport blade 72*d*.

However, the reverse-transport blade 74A may prevent the developer 8 that is forward-transported downstream in the first transport direction D1 in the first transport path 63, from being continuously forward-transported by the extension forward-transport blade 72*d*, and the reverse-transport blade 74A provided upstream in the first transport direction D1 relative to the extension forward-transport blade 72*d* may send and deliver the developer 8 to the second transport path 64 through the first connection portion 67. That is, most of the developer 8 is transported so as to flow in a circulating manner.

In the case where the plate-shaped transport blades 75 are provided adjacent to the helical reverse-transport blade 74B as with the first screw auger 72 of the second exemplary embodiment or in the case where the helical extension forward-transport blade 72*d* is provided adjacent to the helical reverse-transport blade 74A as with the first screw auger 72 of the above-described modification, each of the helical reverse-transport blades 74B and 74A here may be provided so that the length of a portion of the corresponding helical reverse-transport blade protruding downstream in the first transport direction D1 from the position in the first transport path 63 (the boundary M) corresponding to the end 67*a*, upstream in the first transport direction D1, of the first connection portion 67 is equal to at least three pitches.

In this case, when such a protruding portion of the reverse-transport blade 74B has a length equal to at least three pitches, the developer 8 forward-transported in the first transport direction D1 in the first transport path 63 may be likely to stay in a downstream end portion of the first transport path 63 in the first transport direction D1, and a relative decrease in the density of the image portion caused by a decrease in the density of the above-described toner image may thereby be suppressed. In this case, while the reverse-transport blade 74A and the reverse-transport blade 74B ensure that the developer 8 forward-transported in the first transport direction D1 in the first transport path 63 moves to the second transport path 64 through the first connection portion 67, the density of the toner image developed at the portion corresponding to the partial region Edj that is a downstream region of the development region Ed may be suppressed from being relatively lowered. Moreover, even if no constituent is provided adjacent to the helical reverse-transport blade 74A as with the first screw auger 72 of the first exemplary embodiment, the reverse-transport blade 74A may be provided so that the length of a portion of the reverse-transport blade 74A protruding downstream in the first transport direction D1 from the above-described boundary M is equal to at least three pitches.

The image forming apparatus is not limited to the image forming apparatus 1 having a configuration exemplified by, for example, the first exemplary embodiment and may be any image forming apparatus in which the developing devices 6A and 6B illustrated in the present disclosure are usable.

For example, the image forming apparatus may include, as the image forming device 2, an image forming device to which an intermediate transfer system is applied and may include an image forming device capable of forming a multicolored image rather than a monochrome image. The development-region passing body in the developing device is not limited to the developing roller 71 and may be a member in a form other than a roller form.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A developing device comprising:

a development-region passing body that passes a development region while holding a developer;

a first transport path in which the developer to be supplied to the development-region passing body is transported at least in a first transport direction;

a second transport path in which the developer to be sent to the first transport path is transported at least in a second transport direction;

a first connection portion through which a portion of the first transport path positioned short of a first-transport-direction-downstream end of the first transport path and a portion of the second transport path positioned short of a second transport-direction-upstream end of the second transport path are connected to one another; and a first transport member having a rotating shaft on which a helical first forward-transport blade is provided, the helical first forward-transport blade rotating to forward-transport the developer in the first transport direction in the first transport path, wherein the first transport member has a helical reverse-transport blade that reverse-transports the developer in a reverse direction reverse to the first transport direction, the reverse-transport blade is provided on at least a portion of part of the rotating shaft adjacent to the first connection portion, and a reverse-direction-downstream end of the reverse-transport blade reaches at least a first-transport-direction-upstream end of the first connection portion, wherein the reverse-direction-downstream end of the reverse-transport blade exceeds the first-transport-direction-upstream end of the first connection portion and is positioned, in the first transport path, upstream in the first transport direction relative to the first-transport-direction-upstream end of the first connection portion.

2. An image forming apparatus comprising:

a latent image holding body that holds a latent image; and a developing device that develops the latent image of the latent image holding body by using a developer, wherein the developing device is constituted by the developing device according to claim 1.

3. The developing device according to claim 1, wherein the helical reverse-transport blade is wound with a predetermined pitch, and the reverse-direction-downstream end of the reverse-transport blade is positioned, in the first transport path, further upstream in the first transport direction than the first-transport-direction-upstream end of the first connection portion by a distance less than or equal to one pitch.

4. The developing device according to claim 1, wherein the reverse-direction-downstream end of the reverse-transport blade is positioned downstream in the first transport direction relative to a first-transport-direction-downstream end of a portion of the development-region passing body facing the development region.

5. The developing device according to claim 4, wherein the helical reverse-transport blade is wound with a predetermined pitch, and the reverse-direction-downstream end of the reverse-transport blade is positioned, in the first transport path, further upstream in the first transport direction than the first-transport-direction-upstream end of the first connection portion by a distance less than or equal to one pitch.

6. The developing device according to claim 1, wherein the reverse-direction-downstream end of the reverse-transport blade is positioned downstream in the first transport direction relative to a first-transport-direction-downstream end of a portion of the development-region passing body facing the development region.

7. The developing device according to claim 6, wherein the helical reverse-transport blade is wound with a predetermined pitch, and the reverse-direction-downstream end of the reverse-transport blade is positioned, in the first transport path, further upstream in the first transport direction than the first-transport-direction-upstream end of the first connection portion by a distance less than or equal to one pitch.

8. The developing device according to claim 1, wherein the reverse-transport blade is provided astride a boundary of the first transport path with the first connection portion.

9. The developing device according to claim 8, wherein the helical reverse-transport blade is wound with a predetermined pitch, and the reverse-direction-downstream end of the reverse-transport blade is positioned, in the first transport path, further upstream in the first transport direction than the first-transport-direction-upstream end of the first connection portion by a distance less than or equal to one pitch.

10. The developing device according to claim 8, wherein the reverse-direction-downstream end of the reverse-transport blade is positioned downstream in the first transport direction relative to a first-transport-direction-downstream end of a portion of the development-region passing body facing the development region.

11. The developing device according to claim 10, wherein the helical reverse-transport blade is wound with a predetermined pitch, and the reverse-direction-downstream end of the reverse-transport blade is positioned, in the first transport path, further upstream in the first transport direction than the first-transport-direction-upstream end of the first connection portion by a distance less than or equal to one pitch.

12. The developing device according to claim 1, wherein the helical reverse-transport blade is wound with a predetermined pitch, and the reverse-transport blade is provided so that a length of a portion of the reverse-transport blade protruding downstream in the first transport direction from a position in the first transport path corresponding to the first-transport-direction-upstream end of the first connection portion is equal to at least three pitches.

13. The developing device according to claim 12, wherein the reverse-transport blade is provided on entire part of the first transport path adjacent to the first connection portion.

14. The developing device according to claim 12, wherein an upper side portion of part of the second transport path adjacent to the first connection portion has an injection port through which the developer is injected into the second transport path.

15. The developing device according to claim 12, wherein the first transport member has a second forward-transport blade provided on a portion of the rotating shaft downstream in the first transport direction relative to a reverse-direction-upstream end of the reverse-transport blade.

16. The developing device according to claim 15, wherein a discharge port through which a portion of the developer is discharged is formed in a portion of the first transport path including the second forward-transport blade that is provided downstream in the first transport direction relative to the reverse-direction-upstream end of the reverse-transport blade or a portion of the first transport path downstream in the first transport direction relative to the second forward-transport blade.

17. The developing device according to claim 12, wherein, downstream in the first transport direction relative to a reverse-direction-upstream end of the reverse-transport blade, the first transport member has at least one plate-shaped blade that sends the developer to the second transport path.

18. The developing device according to claim 17, wherein the first connection portion is formed continuously to a position facing the at least one plate-shaped transport blade.

19. A developing device comprising:

a development-region passing body that passes a development region while holding a developer;

a first transport path in which the developer to be supplied to the development-region passing body is transported at least in a first transport direction;

a second transport path in which the developer to be sent to the first transport path is transported at least in a second transport direction;

a first connection portion through which a portion of the first transport path positioned short of a first-transport-direction-downstream end of the first transport path and a portion of the second transport path positioned short of a second transport-direction-upstream end of the second transport path are connected to one another; and a first transport member having a rotating shaft on which a helical first forward-transport blade is provided, the helical first forward-transport blade rotating to forward-transport the developer in the first transport direction in the first transport path, wherein the first transport member has a helical reverse-transport blade that reverse-transports the developer in a reverse direction reverse to the first transport direction, the reverse-transport blade is provided on at least a portion of part of the rotating shaft adjacent to the first connection portion, and a reverse-direction-downstream end of the reverse-transport blade reaches at least a first-transport-direction-upstream end of the first connection portion, wherein the helical reverse-transport blade is wound with a predetermined pitch, and the reverse-direction-downstream end of the reverse-transport blade is positioned, in the first transport path, further upstream in the first transport direction than the first-transport-direction-upstream end of the first connection portion by a distance less than or equal to one pitch.

* * * * *